US005079808A

United States Patent [19]

Brown

[11] Patent Number: 5,079,808

[45] Date of Patent: Jan. 14, 1992

[54] SPRING BIASED PAPER CLIP

[76] Inventor: Dwight C. Brown, 1516 N. Nicholas St., Arlington, Va. 22205

[21] Appl. No.: 587,029

[22] Filed: Sep. 24, 1990

[51] Int. Cl.[5] ..... A44B 21/00

[52] U.S. Cl. ..... 24/67.7; 24/499; 24/511

[58] Field of Search ..... 24/67.7, 67.5, 67 R, 24/489, 499, 501, 507, 511

[56] References Cited

U.S. PATENT DOCUMENTS

| | | | |
|---|---|---|---|
| 236,242 | 1/1881 | Newth | 24/511 |
| 327,553 | 10/1885 | Heysinger . | |
| 586,937 | 7/1897 | Sell | 24/67.5 |
| 695,292 | 3/1902 | Ermold | 24/511 |
| 2,242,893 | 5/1941 | Linder . | |
| 2,569,371 | 9/1951 | Cohen | 24/511 |
| 3,030,681 | 4/1962 | Phillips | 24/499 |
| 3,597,813 | 8/1971 | Takahashi . | |
| 3,756,550 | 9/1973 | Kollitz . | |
| 4,020,530 | 5/1977 | Sartore | 24/511 |
| 4,228,569 | 10/1980 | Snyder . | |
| 4,506,416 | 3/1985 | Ohminato et al. . | |
| 4,662,039 | 5/1987 | Richardson | 24/511 |
| 4,802,263 | 2/1989 | Lorber . | |
| 4,959,892 | 10/1990 | Wang | 24/499 |

*Primary Examiner*—Victor N. Sakran
*Attorney, Agent, or Firm*—William L. Klima

[57] ABSTRACT

A paper clip comprising a pair of plate elements having clamping edges, hingedly connected together. A cantilever spring extends from an inner surface of one plate element and engages with the inner surface of the opposite plate element. The cantilever spring can provide increasing clamping force with increasing document thickness.

17 Claims, 2 Drawing Sheets

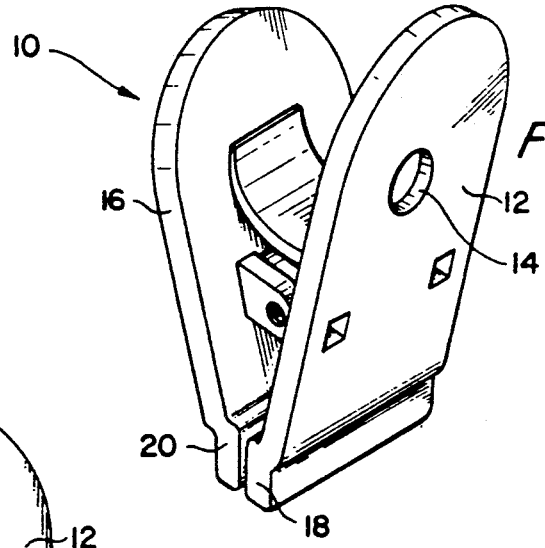
FIG. 1
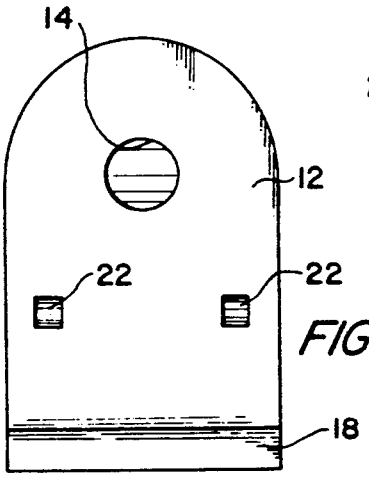
FIG. 2
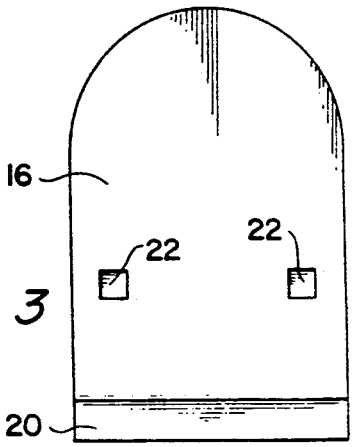
FIG. 3
FIG. 4
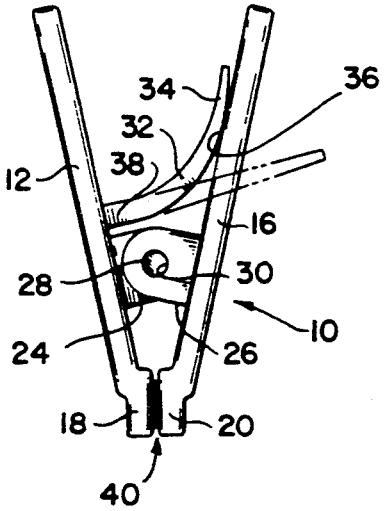
FIG. 5
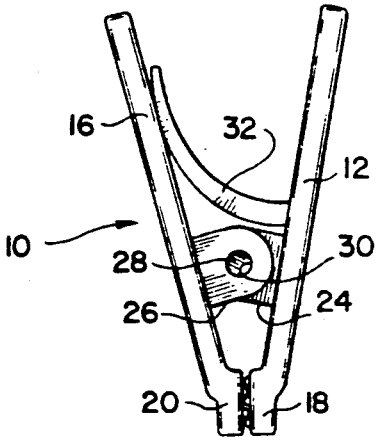
FIG. 6
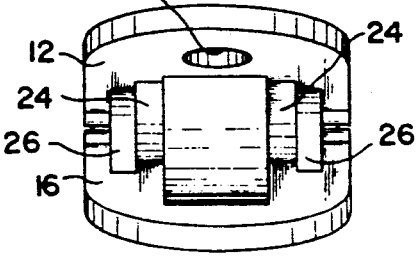
FIG. 7
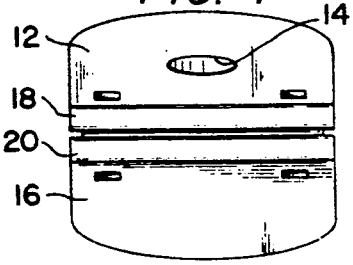

SPRING BIASED PAPER CLIP

FIELD OF THE INVENTION

The present invention is directed to a paper clip, preferably an injection molded assembly. More specifically, a paper clip comprising two (2) plate elements, having clamping edges, hingedly connected together with a cantilever biasing spring extending from one plate element between and engaging with the opposite plate element.

BACKGROUND OF THE INVENTION

There presently exists many varieties of paper clips commercially available and in use today. By far the most highly successful clip has been the conventional bent wire paper clip, which has dominated the field for many years. Variations of the wire paper clips have from time to time been introduced, however, never gaining wide acceptance in the market. However, recently a new paper clip has been introduced that is essentially a thin plate of spring steel bent into a U-shaped cross section that has gained some market share in Japan and is now on sale in the United States. In operation, the plate portions of this paper clip are separated apart and then the clip is slid over for example a document. The edges of the clip are inserted tapered slightly outwardly to form ramp portions to facilitate sliding the edges of the paper therebetween when applying the clip.

Another popular clip designed for handling thick documents is similar to the above-described new paper clip, except the edge portions of the plates forming the clip are provided with bent wire actuators. The bent wire actuators can be pivoted from one position, during use of the clip, to a clip removal position where the bent wire portions use the body of the clip itself as fulcrums for separating the plate edges by pressing the free ends of the bent wire actuators together for removing the clip. These clips are constructed of all metal, and require a number of separate components and bending manufacturing steps of the spring steel plate and the bent wire actuators increasing the costs of manufacturing.

The paper clip according to the present invention can accommodate various width plural sheet documents ranging from a couple of sheets to tens of sheets and provide adequate biasing force in any range of normal document thickness. In contrast, the conventional wire paper clip can only accommodate documents having up to approximately twenty (20) sheets due to the limitation on the amount of bending the inner wire loop can sustain at its base prior to permanent plastic deformation of the wire section located at the base. In order to accommodate thicker documents, the conventional wire paper clip must be somewhat reformed by the fingers of the user, resulting in a clip with inadequate biasing force. The deficiency of the use of the modified conventional paper clip is further exasperated, since thicker documents need a clip with greater biasing force due to the tendency of inner sheets to slip due to an insufficient average biasing force between sheets.

In a different situation, an attempt to use the conventional spring steel type paper clips with documents having few sheets results in operational difficulties. For example, the all metal construction of this clip results in a heavy clip, which tends to bend the edge downwardly at the portion of the document to which it is applied making handling of the document during reading sometimes difficult. Further, the bulky construction of the clip tends to interfere with the fingers of the user reading the document and creates a problem in stacking a plurality of documents having this type of clip. More specifically, this type of clip has a greater dimensional thickness than the document due to its design preventing plural documents to be stacked flatly one on top of each other.

The paper clip of the present invention overcomes a number of problems mentioned above with the popular conventional paper clips. The two piece hingedly connected construction of the clip according to the present invention allows the clip to adequately handle a wide range of document thickness and number of individual sheets. Further, the clip according to the present invention utilizes a unique construction and spring, which results in greater biasing force for documents of increasing thickness. Thus, the varying spring biasing force correlates with the actual spring biasing force required to control and maintain the sheets properly biased together to prevent individual page slippage no matter what the document thickness.

Very importantly, the construction of the spring of the present invention lends itself to high speed and economic manufacturing and assembly. Since the clip can be made of plastic, the separate plate elements can be injection molded with accommodating hinge lugs and biasing spring. The cantilever type spring is molded extending from the inner surface of one or both plate elements. The free end of the cantilever spring engages and cooperates with an inner surface of the opposite plate element during operation. More specifically, the outer free end surface portion of the cantilever spring has a certain amount of curvature and engages with the inner surface of the opposite plate portion. This construction allows the cantilever spring to develop a greater biasing force due to the decreasing length of the moment arm from the base of the spring to the point of contact with the opposite plate portion.

SUMMARY OF THE INVENTION

An object of the present invention is to provide an improved paper clip.

Another object of the present invention is to provide a paper clip comprising two plate elements hingedly connected together with a biasing means disposed therebetween.

An additional object of the present invention is to provide a paper clip comprising two plate elements hingedly connected together with a biasing means disposed therebetween, which is applicable to automatic assembly of the two hinged plate elements by machine operation, as well as manuel assembly.

A further object according to the present invention is to provide a paper clip comprising two plate elements hingedly connected together having a cantilever type spring disposed between the plate elements and extending from one plate element and engaging with the opposite plate element.

Another object according to the present invention is to provide a paper clip comprising two plate elements hingedly connected together with a biasing means that develops an increasing clamping force with increasing document thickness.

A further object according to the present invention is to provide a paper clip comprising two plate elements hingedly connected together with a cantilever type spring extending from the inner surface of one plate element and engaging with the inner surface of the opposite plate element.

BRIEF DESCRIPTION OF THE DRAWINGS

FIG. 1 is a perspective view of the paper clip according to the present invention;

FIG. 2 is front view of the paper clip according to the present invention;

FIG. 3 is a back view of the paper clip shown in FIG. 1;

FIG. 4 is a side view of the paper clip shown in FIG. 1;

FIG. 5 is an opposite side view of the paper clip shown in FIG. 4;

FIG. 6 is a top view of the paper clip shown in FIG. 1;

FIG. 7 is a bottom view of the paper clip shown in FIG. 1;

DETAILED DESCRIPTION OF PREFERRED EMBODIMENTS

Figure 8:
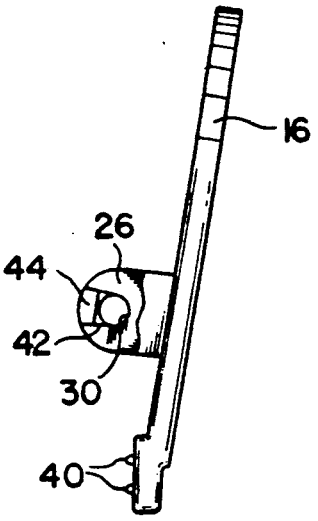
FIG. 8 is a partial side view of one of the plate elements with the closest outer lug removed to view the details of the inner surface of the other outer lug.
Figure 9:
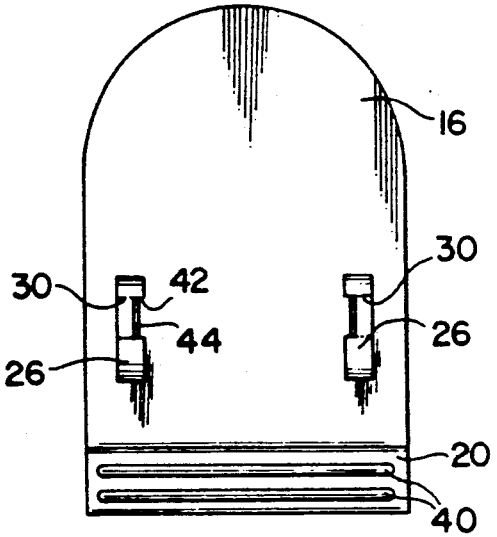
FIG. 9 is a view of the inner surface of one of the plate elements showing the details of the outer hinge lugs.
Figure 10:
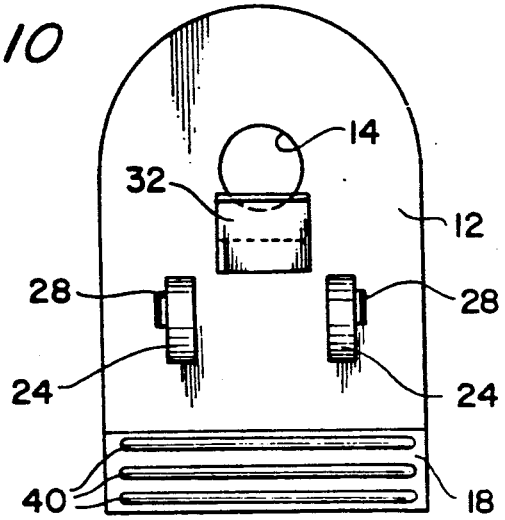
FIG. 10 is a view of the inner surface of the opposite plate element showing the details of the inner lugs having outwardly extending bosses.

A paper clip 10 according to the present invention is shown in FIG. 1. The paper clip 10 comprises a first plate element 12 having a thumb hole 14. The plate element 12 is pivotably or hingedly connected to a second plate element 16. Optionally, one or both plate elements 12,16 can be provided with an additional through hole for hanging the paper clip for example on a wall nail during use. The plate elements 12,16 are provided with clamping edges 18, 20 to concentrate the application of force against the sheets of the document being clamped together.

FIGS. 2 and 3 show front and rear views of the paper clip 10. The plate portions may display core hole indents 22 resulting from a plastic injection molding technique to form the hinge structure of the plate elements 12,16 in an integral manner.

FIGS. 4 and 5 show opposite side views of the paper clip 10. The plate element 12 is provided with a pair of inner hinge lugs 24. Plate element 16 is provided with a pair of outer hinge lugs 26 (see FIG. 6). The inner hinge lugs 24 are provided with outwardly extending bosses 28, which bosses are received or accommodated within through holes 30 in the outer hinge lugs 26 defining the hinge structure of the paper clip 10.

The plate portion 12 is provided with a cantilever mounted spring 32 projecting from its inner surface. The free end 34 of spring 32 engages and cooperates with the inner surface of the plate element 16. More specifically, an outer curved surface portion 36 at or near the free end 34 of the spring 32 engages with the inner surface of plate elements 16 to constantly spring bias the plate elements 12,16 apart. The spring 32 can be molded as an integral unit of the plate element 12 all made of plastic. Thus, the base portion 38 of the spring 32 is securely and rigidly fastened with the plate portion 12 and extends from the inner surface thereof. Further, in a preferred embodiment, the cantilever spring 32 is tapered with the base 38 of the cantilever spring 32 being thicker than the free end 34 thereof. For example, as shown in FIG. 4, the thickness dimension of the base 38 is greater as compared with the thickness dimension of the free end 34 when viewing the paper clip from the side while the width dimension of the cantilever spring is the same at both the base 38 and free end 34, as shown from the top view in FIG. 6. Alternatively, the thickness dimension of the spring can remain constant while the width dimension of the spring can remain constant while the width dimension of the spring varies in thickness to achieve the same result. Alternatively, separate cantilever springs can be provided extending from the inner surface of both plate elements 12,16 with each spring being one-half or less the width of the paper clip. In other alternative embodiments, a plurality of cantilever springs can extend from the inner surface of one or both plate elements 12,16 to vary the clamping power and uniformity of the paper clip.

During manufacture of the paper clip 10, the cantilever spring 32 can be molded so as to extend straight at an approximate ninety (90) degree angle from the inner surface of the plate element 12. During assembly of the plate elements 12 and 16 together, the cantilever spring 32 is bent in the curved shaped shown in FIGS. 4 and 5. Alternatively, the spring 12 can be molded with some initial curvature to facilitate assembly.

The cantilever spring 32 having curvature in at least the assembled paper clip configuration and mounted between the plate elements 12,16 provides a unique property of the paper clip 10. As portions of the plate elements 12,16 above the hinge axis are pressed together, for example between a users thumb and index finger, the lower portions of the plate elements below the hinge axis open apart to accommodate the item to be clamped such as a document. As the upper portions of the plate elements 12,16 above the hinge axis are moved together, the spring 32 produces an increasing spring biasing force between the upper portions of these plate elements. The increasing biasing force is a result of the decreasing length of the moment arm, the length of which being defined between the base of the spring 32 to the point of contact with the spring with the inner surface of the plate portion 16. Further, the increasing curvature of the spring also produces local increasing biasing force based on strength of materials formulations and concepts.

This particular feature results in a practical advantage in that the paper clip of the present invention provides a greater biasing force between the clamping edges 18,20 with increasing document thickness. The thicker the document the greater the clamping force that is provided to prevent sheet slippage between various sheets and subsets of sheets. A greater clamping force is required due to the greater number of sheet surface-to-sheet surface interfaces each requiring a certain average clamping force to provide a sufficient surface shear force between sheet surface interfaces to prevent slippage.

The inner surfaces of the clamping edge portions 18,20 can be provided with force concentration projections such as ridges 40 or pointed nodes to aid in the prevention of sheet slippage of a document. Various shapes, sizes, number of projections and material composition can be selected and tailored to a particular application such as clamping bond paper documents verses hard manillia type sheets.

FIG. 8 is a partial side view of the plate element 16 with the closest outer hinge lug 26 removed to view the inner detail of the other outer hinge lug 26. Each outer hinge lug 26 is molded with a groove 42 and a ramp section 44 to facilitate the assembly of the paper clip 10. More specifically, the ramp section 44 of each outer hinge lug 26 engages with the outer tip of the boss 28 of each inner hinge lug 24 to guide the bosses 28 through the grooves 42 and into the through hole 30 of each outer hinge lug 26. Once the bosses 28 clear past the sliding surfaces of the grooves (i.e. bottoms of the grooves), the bosses then snap into the through holes 30 to complete the assembly.

In an alternative assembly, the paper clip of the present invention can be constructed to include some or all metal parts. For example, spring steel strips can be stamped and bent to provide the cantilever spring extending from one plate element and hinge structure. Rivets can be used to rivet the lugs together forming the hinge structure.

I claim:

1. A paper clip, comprising:

a first plate element having a paper clamping edge;

a second plate element hingedly connected to said first plate element, said second plate element having a paper clamping edge;

a hinge connection positioned between and hingedly connecting said plate elements; and a curved tapered cantilever spring extending for one plate element and located between said plate elements, said cantilever spring having a base portion connected to one plate element and being thicker than a free end portion thereof, said free end portion of said cantilever spring including an outer curved surface portion slidably engaging with the other plate element for biasing portions of said plate elements apart while biasing other portions of said plate elements including said paper clamping edges together about said hinge connection.

2. A paper clip according to claim 1, wherein said base portion of said curved cantilever spring is positioned adjacent said hinge connection with a remaining portion curving away from said hinge connection in a direction away from said paper clamping edges.

3. A paper clip according to claim 2, wherein said hinge connection positions said plate elements a preselected distance apart at said hinge connection.

4. A paper clip according to claim 3, wherein said base portion of said cantilever spring is positioned substantially perpendicular relative to the plate element from which said base portion extends.

5. A paper clip according to claim 4, wherein said base portion of said cantilever spring is positioned on a side of said hinge connection opposite to said paper clamping edges.

6. A paper clip according to claim 3, wherein said base portion of said cantilever spring is positioned on a side of said hinge connection opposite to said paper clamping edges.

7. A paper clip according to claim 3, wherein a free end portion of said cantilever spring is curved away from said plate element that slidably contacts with said cantilever spring.

8. A paper clip according to claim 1, wherein said plate elements, hinge connection and spring are configured to reduce the movement arm of the cantilever spring as the clamping edge portions are pivoted apart by pressing opposite portions of the plate portions located on opposite sides of a hinge axis creating a increasing biasing force of the spring and greater clamping force of the paper clip.

9. A paper clip according to claim 1, wherein the hinge connection is defined by a pair of outer hinge lugs located on one plate elements cooperating with a pair of inner fitting lug portions located on an opposite plate element.

10. A paper clip according to claim 9, wherein said inner lug elements are provided with outwardly extending bosses which are received within through holes in the outer lug elements.

11. A paper clip according to claim 10, wherein inner surfaces of the outer lug portions are each provided with a ramp section extending into a groove leading into the through hole to accommodate the boss of the respective inner lug portion to facilitate assembly of the clip.

12. A paper clip according to claim 1, wherein the clamping edges are provided with force concentrating projections to prevent sheet slippage of a document.

13. A paper clip according to claim 1, wherein the paper clip is made of plastic providing a light weight and sufficient biasing force paper clamp.

14. A paper clip according to claim 13, wherein the paper clip is constructed of injection molded plastic elements providing elastic characteristics of the cantilever spring consistent with operation of the paper clip.

15. A paper clip according to claim 1, wherein the thickness dimension of said base portion of said cantilever spring is thicker than said free end portion while the width dimension of said base portion is the same as the width dimension of said free end portion.

16. A paper clip, comprising:

a first plate element including a paper clamping section;

a second plate element hingedly connected to said first plate element, said second plate element having a paper clamping section;

a hinge connection defined by a set of lugs of said first plate element connecting with a set of lugs having pins of said second plate element, said lugs maintain said plate elements at a preselected distance apart at said hinge connection;

a curved tapered cantilever spring including a base portion connected to one plate element and positioned adjacent said hinge connection, said cantilever spring shaped to curve away from said hinge connection and including a curved free end portion slidably contacting with the other plate element to bias said paper clamping sections together about said hinge connection, said base portion of said curved cantilever spring being thicker than said free end portion thereof.

17. A paper clip according to claim 16, wherein the thickness dimension of said base portion of said cantilever spring is thicker than said free end portion while the width dimension of said base portion is the same as the width dimension of said free end portion.

* * * * *